US007737907B2

(12) United States Patent
Tsai et al.

(10) Patent No.: US 7,737,907 B2
(45) Date of Patent: Jun. 15, 2010

(54) PLANAR ANTENNA

(75) Inventors: Tiao-Hsing Tsai, Yungho (TW); Chih-Wei Liao, Yilan Shien (TW); Chao-Hsu Wu, Tao Yuan Shien (TW)

(73) Assignee: Quanta Computer Inc. (TW)

( * ) Notice: Subject to any disclaimer, the term of this patent is extended or adjusted under 35 U.S.C. 154(b) by 31 days.

(21) Appl. No.: 12/174,757

(22) Filed: Jul. 17, 2008

(65) Prior Publication Data

US 2009/0237308 A1 Sep. 24, 2009

(30) Foreign Application Priority Data

Mar. 19, 2008 (TW) ..... 97109619 A

(51) Int. Cl.
*H01Q 9/30* (2006.01)

(52) U.S. Cl. ..... 343/828; 343/702; 343/829

(58) Field of Classification Search ..... 343/700 MS, 343/702, 846, 828–830, 833
See application file for complete search history.

(56) References Cited

U.S. PATENT DOCUMENTS 6,999,031 B2 * 2/2006 Berezin et al. ..... 343/702

* cited by examiner

*Primary Examiner*—Michael C Wimer
(74) *Attorney, Agent, or Firm*—Sunstein Kann Murphy & Timbers LLP

(57) ABSTRACT

An antenna includes first and second radiating elements. The first radiating element is operable in a first frequency range. The second radiating element cooperates with the first radiating element to define a slot therebetween in such a manner that the second radiating element is coupled electromagnetically to the first radiating element. The construction as such permits operation of the second radiating element in a second frequency range different from the first frequency range, and a third frequency range different from the first and second frequency ranges.

19 Claims, 7 Drawing Sheets

PLANAR ANTENNA

CROSS-REFERENCE TO RELATED APPLICATION

This application claims priority of Taiwanese application no. 097109619, filed on Mar. 19, 2008.

BACKGROUND OF THE INVENTION

1. Field of the Invention

This invention relates to an antenna, more particularly to an antenna that is applicable to a wireless personal area network (WPAN), a wireless local area network (WLAN), and a worldwide interoperability for microwave access (WiMAX).

2. Description of the Related Art

A conventional antenna, which is applicable to a wireless local area network (WLAN), a wireless personal area network (WPAN), and a worldwide interoperability for microwave access (WiMAX), is well known in the art.

The conventional antenna, however, is three dimensional in shape, and thus has a complicated structure that gives rise to inconvenience during assembly and an increase in manufacturing costs.

SUMMARY OF THE INVENTION

Therefore, the object of the present invention is to provide an antenna that can overcome the aforesaid drawbacks of the prior art.

According to the present invention, an antenna comprises first and second radiating elements. The first radiating element is operable in a first frequency range and includes a feeding end. The second radiating element is provided with a grounding point, and cooperates with the first radiating element to define a slot therebetween in such a manner that the second radiating element is coupled electromagnetically to the first radiating element to thereby permit operation of the second radiating element in a second frequency range different from the first frequency range, and a third frequency range different from the first and second frequency ranges.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
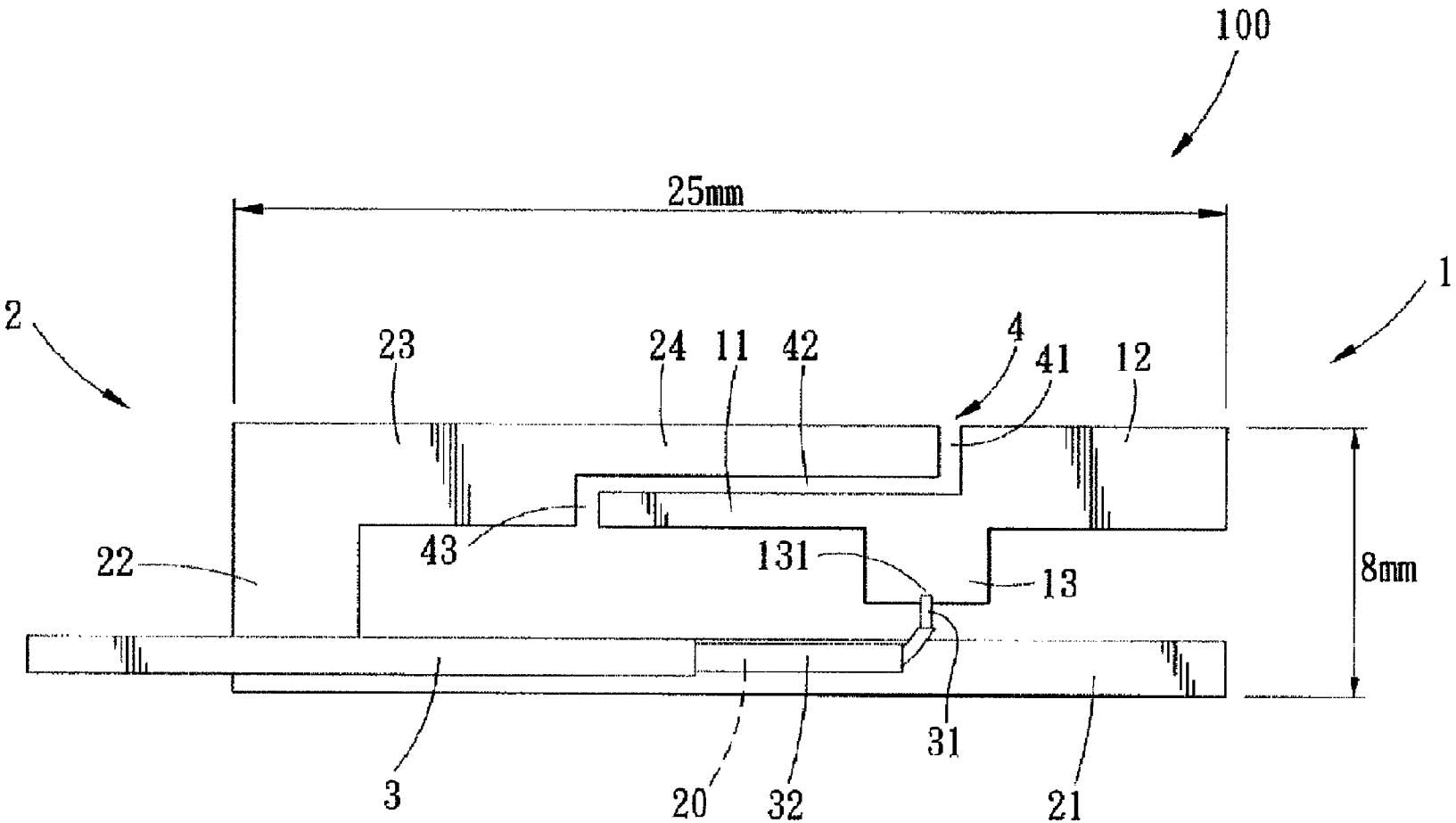
FIG. 1 is a schematic view of the preferred embodiment of an antenna according to this invention.

Referring to FIG. 1, the preferred embodiment of an antenna 100 according to this invention is shown to include first and second radiating elements 1, 2.

The antenna 100 of this invention is a planar antenna, and is applicable to a wireless local area network (WLAN), a wireless personal area network (WPAN), and a worldwide interoperability for microwave access (WIMAX). That is, the antenna 100 of this invention is operable in a Bluetooth frequency range from 2.4 GHz to 2.5 GHz, an ultra-wideband (UWB) Band I frequency range from 3.1 GHz to 4.8 GHz, a 802.11b/g frequency range from 2.4 GHz to 2.5 GHz, a 802.11a frequency range from 4.9 GHz to 5.9 GHz, a WiMAX-I frequency range from 2.3 GHz to 2.7 GHz, and a WiMAX-II frequency range from 3.3 GHz to 3.8 GHz.

Figure 2:
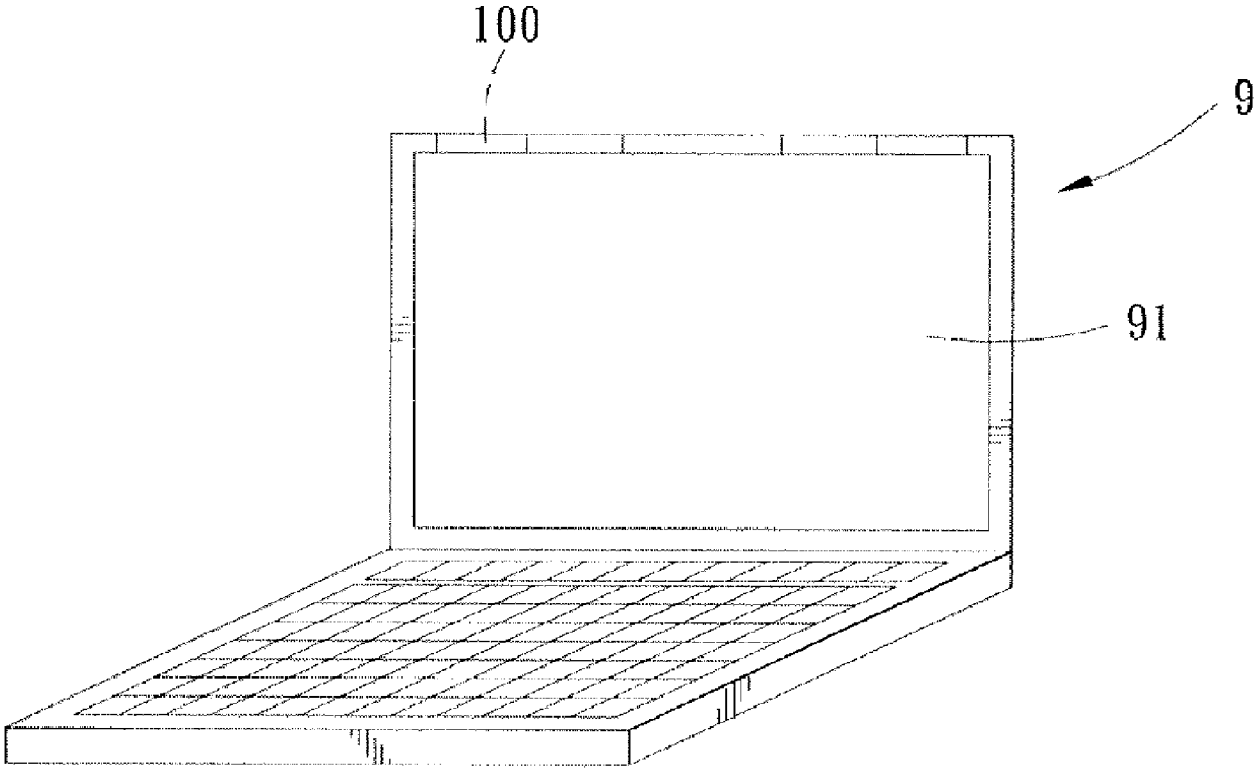
FIG. 2 is a perspective view illustrating an exemplary application in which the preferred embodiment is installed in a notebook computer.

Furthermore, in this embodiment, the antenna 100 has a length of 25 millimeters and a width of 8 millimeters, and as illustrated in FIG. 2, is installed in a notebook computer 9 and is disposed above a display 9 of the notebook computer 9.

The first radiating element 1 is operable in a first frequency range from 3.2 GHz to 4.8 GHz, has a length of one-quarter wavelength in the first frequency range, and includes first and second segments 11, 12, a third segment 13, and a feeding end 131. The first and second segments 11, 12 of the first radiating element 1 are opposite to each other. The third segment 13 of the first radiating element 1 extends transversely to the first and second segments 11, 12 of the of the first radiating element 1, and has a first end that is connected to a junction of the first and second segments 11, 12 of the first radiating element 1, and a second end that is opposite to the first end thereof, that defines the feeding end 131, and that is connected to a positive terminal 31 of a coaxial cable 3. In this embodiment, the second segment 12 of the first radiating element 1 has a width wider than that of the first segment 11 of the first radiating element 1.

The second radiating element 2 cooperates with the first radiating element 1 to define a slot 4 therebetween in such a manner that the second radiating element 2 is coupled electromagnetically to the first radiating element 1. The construction as such permits operation of the second radiating element 2 in a second frequency range from 2.3 GHz to 3.5 GHz and a third frequency range from 4.6 GHz to 6 GHz. In this embodiment, the second radiating element 2 has a length of one-quarter wavelength in the second frequency range, and includes first, second, third, and fourth segments 21, 22, 23, 24. The first segment 21 of the second radiating element 2 is connected to an electrical ground (not shown) of the notebook computer 9, and is provided with a grounding point 20 that is connected to a negative terminal 32 of the coaxial cable 3. The second segment 22 of the second radiating element 2 extends transversely from the first segment 21 of the second radiating element 2, and has a first end connected to an end of the first segment 21 of the second radiating element 2, and a second end opposite to the first end thereof. The first radiating element 1 is disposed between the first and second segments 21, 22 of the second radiating element 2. The third segment 23 of the second radiating element 2 extends transversely from the second segment 22 of the second radiating element 2 toward the first radiating element 1, and has a first end connected to the second end of the second segment 22 of the second radiating element 2, and a second end opposite to the first end thereof. The fourth segment 24 of the second radiating element 2 extends from the second end of the third segment 23 of the second radiating element 2 and is disposed above the first segment 11 of the first radiating element 1. In this embodiment, the third segment 23 of the second radiating element 2 has a width that is wider than that of the fourth segment 24 of the second radiating element 2 and that is equal to that of the second segment 12 of the first radiating element 1. Moreover, in this embodiment, the fourth segment 24 of the second radiating element 2 is parallel to the first segment 11 of the first radiating element 1.

The slot 4 includes first, second, and third segments 41, 42, 43. The first segment 41 of the slot 4 is defined by the second segment 12 of the first radiating element 1 and the fourth segment 24 of the second radiating element 2. The second segment 42 of the slot 4 extends transversely from the first segment 41 of the slot 4, and is defined by the first segment 11 of the first radiating element 1 and the fourth segment 24 of the second radiating element 2. The third segment 43 of the slot 4 extends transversely from the second segment 42 of the slot 4, and is defined by the first segment 11 of the first radiating element 1 and the third segment 23 of the second radiating element 2. In this embodiment, the slot 4 has a length that is less than one-quarter wavelength in the first frequency range to thereby prevent the antenna 100 of this invention to cause interference.

It is noted that the slot 4 has a width that may be adjusted to strengthen or weaken the electromagnetic coupling between the first and second radiating elements 1, 2 in order to obtain a desired impedance for the antenna 100 of this invention. Moreover, the feeding end 131 of the first radiating element 1 has a length or width that may be adjusted to obtain an impedance match. Further, the first frequency range may be adjusted by altering the length of either the first or second segments 11, 12 of the first radiating element 1, and the second and third frequency ranges may be adjusted by altering either the length or width of the third segment 23 of the second radiating element 2. In addition, the first and second radiating elements 1, 2 may be formed on a dielectric substrate (not shown).

Figure 3:
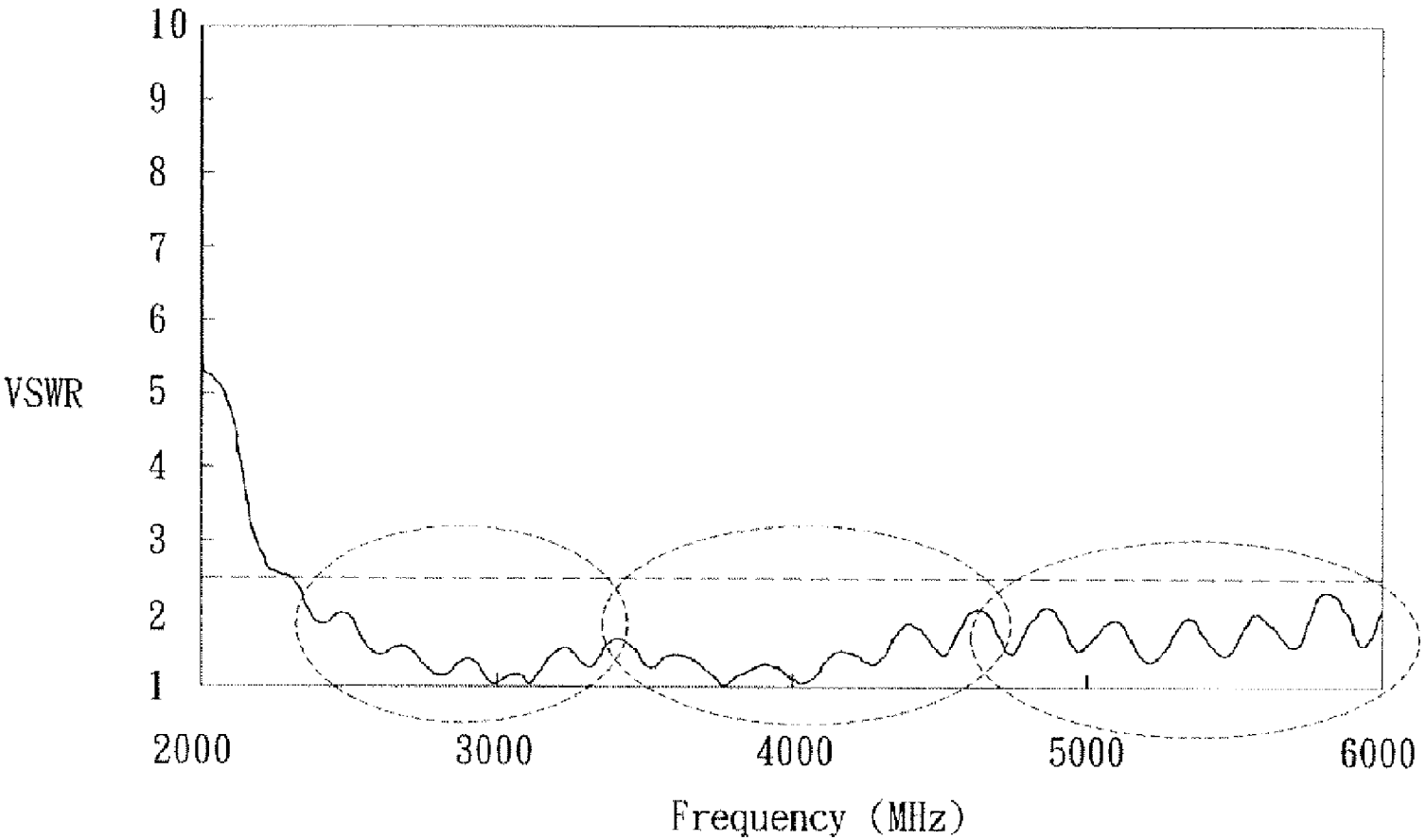
FIG. 3 is a plot illustrating a voltage standing wave ratio (VSWR) of the preferred embodiment.
Figure 4:
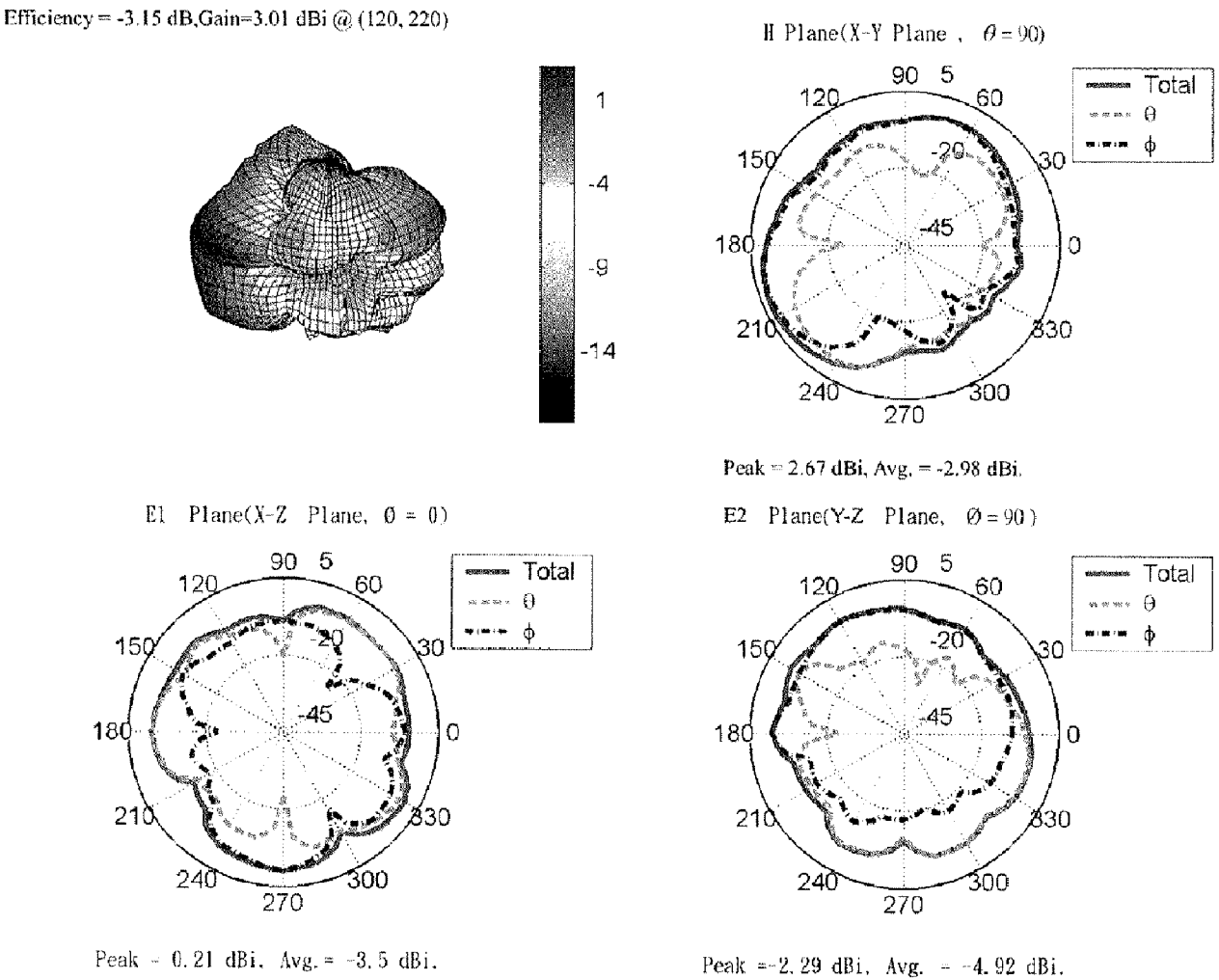
FIG. 4 shows plots of radiation patterns of the preferred embodiment respectively on the x-y, x-z, and y-z planes when operated at 2440 MHz.
Figure 5:
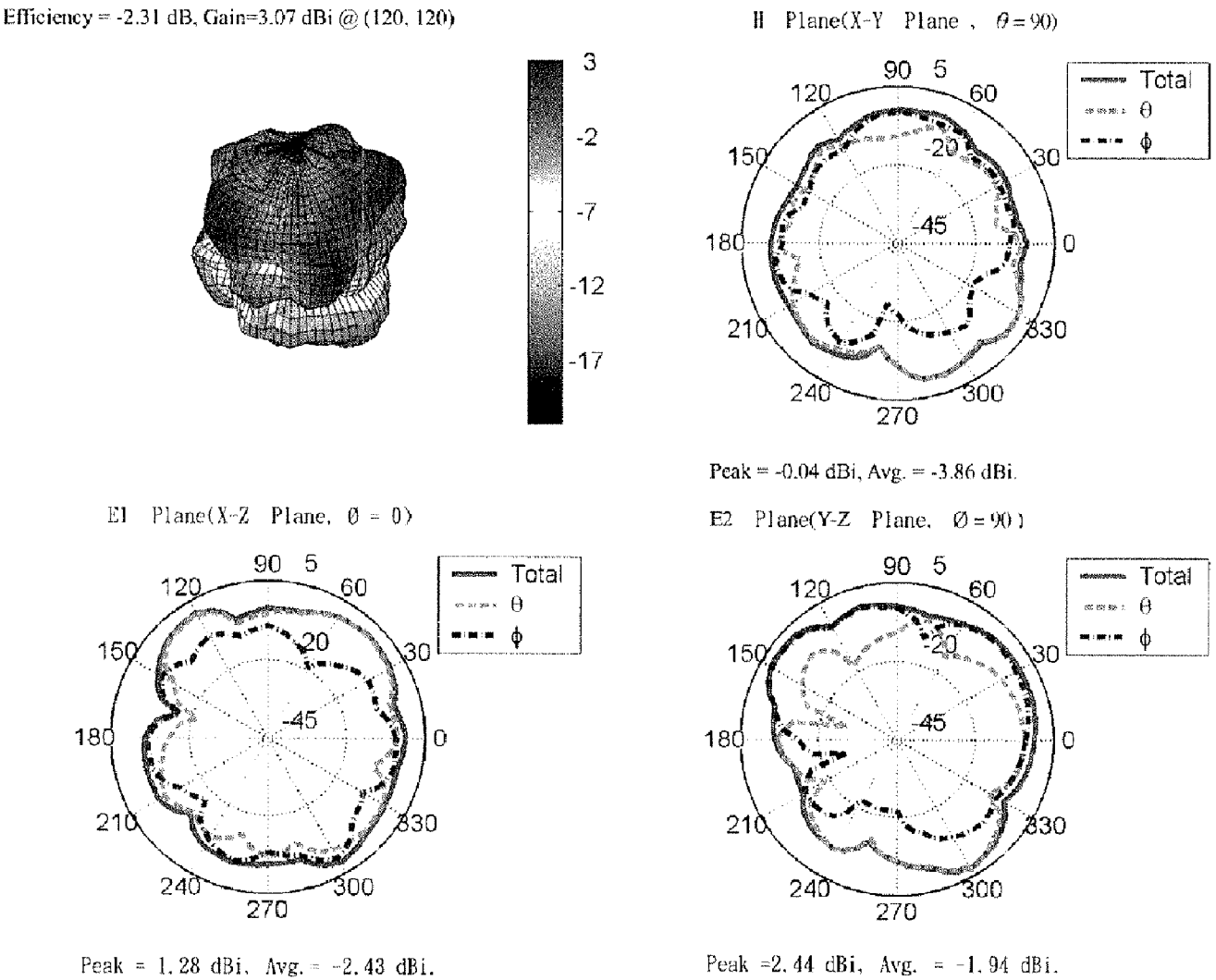
FIG. 5 shows plots of radiation patterns of the preferred embodiment respectively on the x-y, x-z, and y-z planes when operated at 4224 MHz.
Figure 6:
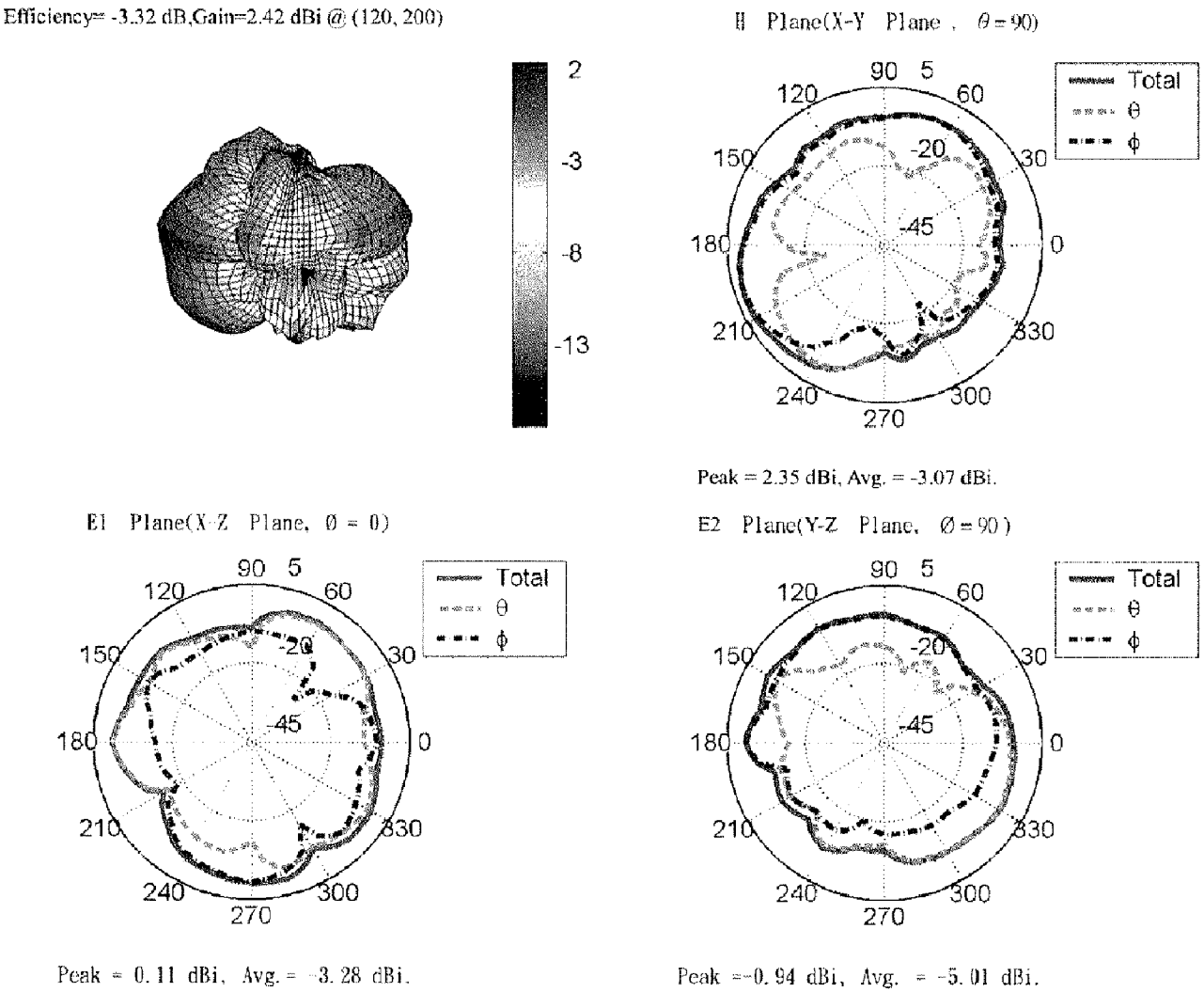
FIG. 6 shows plots of radiation patterns of the preferred embodiment respectively on the x-y, x-z, and y-z planes when operated at 2437 MHz.
Figure 7:
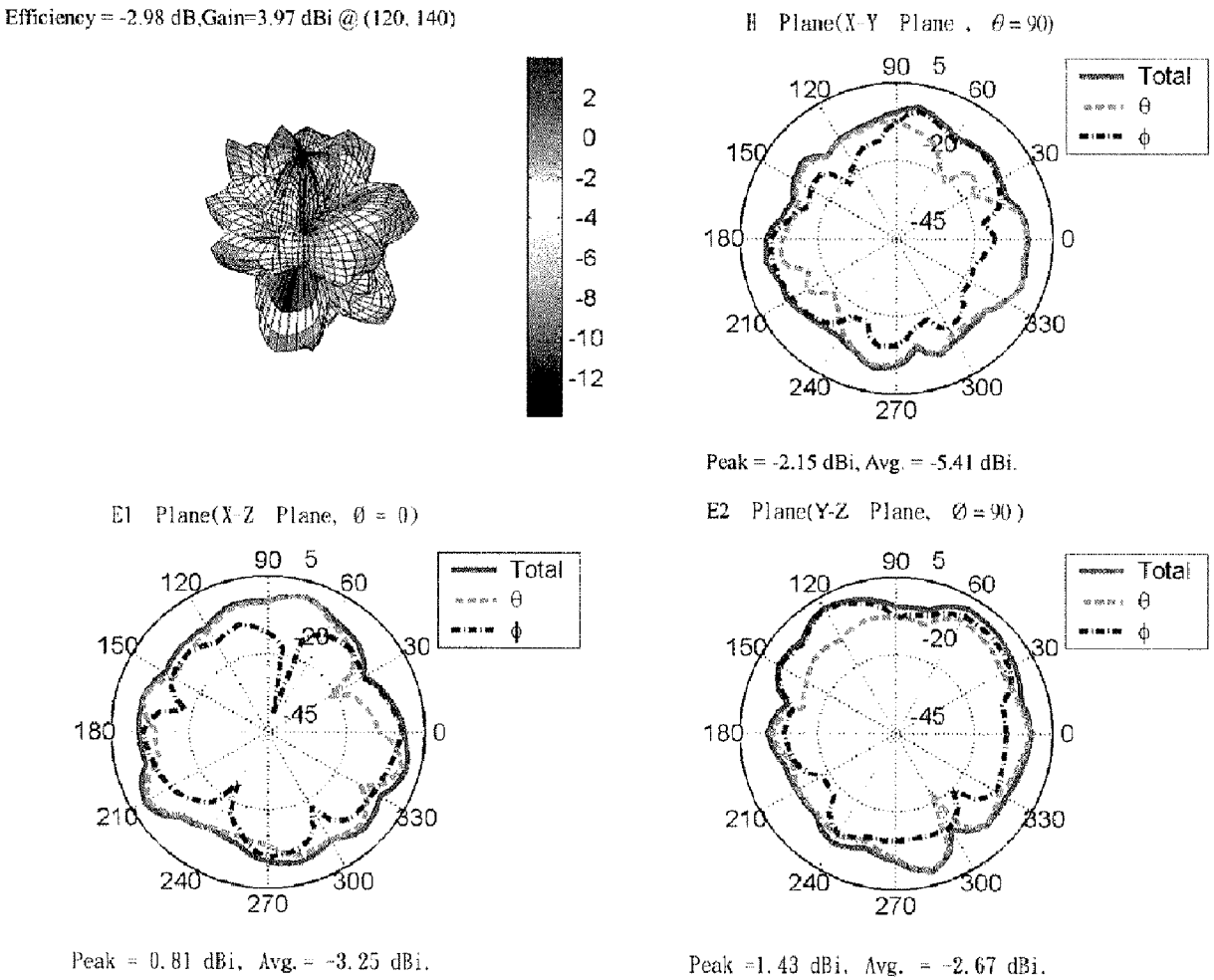
FIG. 7 shows plots of radiation patterns of the preferred embodiment respectively on the x-y, x-z, and y-z planes when operated at 5470 MHz.

Experimental results, as illustrated in FIG. 3, show that the antenna 100 of this invention achieves a voltage standing wave ratio (VSWR) of less than 2.5 when operated between 2.3 GHz and 6.0 GHz. Moreover, the antenna 100 of this invention has total radiation powers (TRPs) greater than −3.5 dB and efficiencies greater than 40% when operated in the Bluetooth and UWB Band I frequency ranges, as shown in Table I, and the 802.11 a/b/g frequency ranges, as shown in Table II. Hence, the antenna 100 of this invention indeed has a high gain. Further, as illustrated in FIGS. 4 to 7, the antenna 100 of this invention has substantially omnidirectional radiation patterns when operated at 2440 MHz, 4224 MHz, 2437 MHz, and 5470 MHz, respectively.

TABLE I

| Frequency (MHz) | TRP (dB) | Efficiency (%) |
|---|---|---|
| 2402 | −3.38 | 45.89 |
| 2440 | −3.15 | 48.53 |
| 2480 | −3.49 | 44.78 |
| 3168 | −1.81 | 65.88 |
| 3432 | −2.60 | 54.90 |
| 3696 | −1.94 | 64.04 |
| 3960 | −2.15 | 61.02 |
| 4224 | −2.31 | 58.62 |
| 4488 | −2.54 | 55.67 |
| 4752 | −2.16 | 60.75 |

TABLE II

| Frequency (MHz) | TRP (dBm) | Efficiency (%) |
|---|---|---|
| 2412 | −3.43 | 45.41 |
| 2437 | −3.32 | 46.66 |
| 2462 | −3.49 | 44.82 |
| 4900 | −3.02 | 49.89 |
| 5150 | −2.47 | 56.59 |
| 5350 | −3.46 | 45.08 |
| 5470 | −2.98 | 50.64 |
| 5725 | −3.28 | 46.99 |
| 5875 | −3.09 | 49.09 |

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna comprising:

a first radiating element operable in a first frequency range, and including a feeding end; and a second radiating element provided with a grounding point, and cooperating with said first radiating element to define a slot therebetween in such a manner that said second radiating element is coupled electromagnetically to said first radiating element to thereby permit operation of said second radiating element in a second frequency range different from the first frequency range, and a third frequency range different from the first and second frequency ranges, said second radiating element including a first segment that has an end, a second segment that extends transversely from said first segment thereof, said second segment of said second radiating element having a first end connected to said end of said first segment of said second radiating element, and a second end opposite to said first end thereof, a third segment that extends from said second end of said second segment thereof toward said first radiating element, said third segment of said second radiating element having an end distal from said second segment of said second radiating element, and a fourth segment that extends from said end of said third segment thereof and that is disposed above a segment of said first radiating element, said grounding point being provided on said first segment of said second radiating element.

2. The antenna as claimed in claim 1, wherein said slot includes a first segment, a second segment that extends transversely from said first segment thereof, and a third segment that extends transversely from said second segment thereof

3. The antenna as claimed in claim 1, wherein said first radiating element includes opposite first and second segments, and a third segment that extends transversely to said first and second segments thereof, said third segment of said first radiating element having a first end that is connected to a junction of said first and second segments of said first radiating element, and a second end that is opposite to the first end thereof and that defines said feeding end.

4. The antenna as claimed in claim 3, wherein said fourth segment of said second radiating element is disposed above said first segment of said first radiating element.

5. The antenna as claimed in claim 4, wherein said slot includes a first segment, a second segment that extends transversely from said first segment thereof, and a third segment that extends transversely from said second segment thereof.

6. The antenna as claimed in claim 5, wherein said first segment of said slot is defined by said second segment of said first radiating element and said fourth segment of said second radiating element, said second segment of said slot is defined by said first segment of said first radiating element and said fourth segment of said second radiating element, and said third segment of said slot is defined by said first segment of said first radiating element and said third segment of said second radiating element.

7. The antenna as claimed in claim 4, wherein said fourth segment of said second radiating element is parallel to said first segment of said first radiating element.

8. The antenna as claimed in claim 3, wherein said second segment of said first radiating element has a width wider than that of said first segment of said first radiating element.

9. The antenna as claimed in claim 1, wherein the first frequency range covers frequencies from 3.2 GHz to 4.8 GHz.

10. The antenna as claimed in claim 1, wherein the second frequency range covers frequencies from 2.3 GHz to 3.5 GHz.

11. The antenna as claimed in claim 1, wherein the third frequency range covers frequencies from 4.6 GHz to 6.0 GHz.

12. The antenna as claimed in claim 1, wherein said antenna has a length of 25 millimeters and a width of 8 millimeters.

13. An antenna comprising:

a first radiating element operable in a first frequency range, and including a feeding end; and a second radiating element provided with a grounding point, and cooperating with said first radiating element to define a slot therebetween in such a manner that said second radiating element is coupled electromagnetically to said first radiating element to thereby permit operation of said second radiating element in a second frequency range different from the first frequency range, and a third frequency range different from the first and second frequency ranges, wherein said first radiating element includes opposite first and second segments, and a third segment that extends transversely to said first and second segments thereof, said third segment of said first radiating element having a first end that is connected to a junction of said first and second segments of said first radiating element, and a second end that is opposite to the first end thereof and that defines said feeding end.

14. The antenna as claimed in claim 13, wherein said slot includes a first segment, a second segment that extends transversely from said first segment thereof, and a third segment that extends transversely from said second segment thereof.

15. The antenna as claimed in claim 13, wherein said second segment of said first radiating element has a width wider than that of said first segment of said first radiating element.

16. The antenna as claimed in claim 13, wherein the first frequency range covers frequencies from 3.2 GHz to 4.8 GHz.

17. The antenna as claimed in claim 13, wherein the second frequency range covers frequencies from 2.3 GHz to 3.5 GHz.

18. The antenna as claimed in claim 13, wherein the third frequency range covers frequencies from 4.6 GHz to 6.0 GHz.

19. The antenna as claimed in claim 13, wherein said antenna has a length of 25 millimeters and a width of 8 millimeters.

* * * * *